US006017429A

United States Patent [19]

Persson

[11] Patent Number: 6,017,429

[45] Date of Patent: Jan. 25, 2000

[54] CATHODE ELEMENT AND A METHOD OF ITS MANUFACTURE

[75] Inventor: Sture V. Persson, Skellefteå , Sweden

[73] Assignee: Svedala Skega AB, Ersmark, Sweden

[21] Appl. No.: 09/011,906

[22] PCT Filed: Aug. 9, 1996

[86] PCT No.: PCT/SE96/01000

§ 371 Date: May 27, 1998

§ 102(e) Date: May 27, 1998

[87] PCT Pub. No.: WO97/07263

PCT Pub. Date: Feb. 27, 1997

[30] Foreign Application Priority Data

Aug. 21, 1995 [SE] Sweden ..... 9502889

[51] Int. Cl.[7] ..... C25D 1/00

[52] U.S. Cl. ..... 204/281; 204/286; 204/288; 204/280; 264/177.17; 264/230; 264/231; 264/239; 264/248; 264/252; 264/299; 264/325; 264/328.1; 264/331.13

[58] Field of Search ..... 204/281, 286, 204/288, 280; 205/575, 76; 264/177.17, 230, 231, 239, 248, 252, 299, 325, 328.1, 331.13

[56] References Cited

U.S. PATENT DOCUMENTS

| | | | |
|---|---|---|---|
| 3,523,873 | 8/1970 | Elkin | 204/286 |
| 4,207,147 | 6/1980 | Babin | 204/281 |
| 4,670,124 | 6/1987 | Bartsch et al. | 204/281 |
| 4,749,464 | 6/1988 | Dufresne et al. | 204/3 |

*Primary Examiner*—Bruce F. Bell
*Attorney, Agent, or Firm*—Pillsbury Madison & Sutro LLP

[57] ABSTRACT

The present invention relates to an improved cathode element for the production of electrolytic copper, and more particularly to an improved cathode element of the reusable type which includes a cathode plate. With the intention of preventing a sleeve-like copper build-up around the cathode plate, the cathode element is provided with electrically insulating edge strips along at least those side edges of the cathode element which, in an active position, are located in the electrolyte bath, wherein the electrically insulating edge strips are chemically bonded to the cathode plate, preferably by vulcanization or by gluing.

8 Claims, 1 Drawing Sheet

CATHODE ELEMENT AND A METHOD OF ITS MANUFACTURE

This application is the national phase of International application PCT/SE96/01000 filed Aug. 9, 1996 which designated the U.S.

The present invention relates to an improved cathode element for the production of electrolytic copper, and more particularly to an improved reusable type of cathode element. The invention also relates to a method of manufacturing the cathode element.

In recent times, more and more electrolytic copper production plants have switched from the use of copper cathode plates intended for one-time use only to the use of reusable cathode elements made of stainless, acid-proof steel plate, for instance. Because copper coatings that precipitate onto a steel cathode plate do not adhere particularly firmly to the plate, the coating can be removed quite easily from the plate as copper plate and the cathode element can be returned to the electrolytic bath and reused.

However, in order for the copper coating to be easily removed from the cathode element it is necessary for the coating to be deposited solely onto the main surfaces of the cathode element and not on its edge surfaces. If the copper coating is permitted to extend around the edge surfaces of the cathode and therewith join the coatings deposited on the front and the rear sides of the cathode element, there is formed a sleeve-like coating which is difficult to remove. In order to avoid deposits in the proximity of the edge surfaces of the plate, the surfaces are insulated against electrical conductivity.

This electrical insulation is at present achieved by fitting insulating clamping strips, normally plastic strips, over the edge surfaces of the cathode plates. These electrically insulating strips have a U-shaped cross-section and are normally dimensioned so that the U-profile will seat against the plate and therewith hold the strip in position.

It is worthy of note in this respect that the cathode elements are located in an extremely difficult environment as the copper builds up on the cathode plate. This environment is both acid and warm (e.g. 16% sulphuric acid at +60° C.) and the cathode elements remain in the electrolytic bath for long periods of time with no interruption (e.g. 7–10 days).

However, the clamping strips provided around the edge surfaces of the cathode element tend to loosen, e.g. as a result of direct contact with some other object or some other cathode element—hits, impacts, wear—or when the precipitated copper coatings are stripped from the main surfaces of the cathode elements. Stripping of the copper plates from the cathode elements is also liable to affect the edge strips mechanically, causing the strips to loosen or inflicting damage thereon.

The environment in which the strips are located also has an affect on their useful life span. Long stay times in high temperatures and in acid environments accelerates relaxation of the material from which the clamping strips are made therewith reducing the strip clamping forces, among other things.

In certain cases, these plastic strips are supplemented internally with a seal, e.g. a sealing strip which lies against the surface of the cathode plate. This seal is intended to reduce the penetration of electrolyte and therewith reduce undesirable copper formations inwardly of the clamping strip. The formation of copper layers is liable to urge the strips away from the cathode plate, causing the strips to fall into the electrolyte bath and unavoidably resulting in the formation of copper around the edge surfaces of the cathode plate and therewith joining the copper coatings on the main surfaces of the plate and rendering stripping of the plate difficult to achieve.

Another problem with known techniques resides in he undercuts that occur at the junction of the strips with the cathode plate. These undercuts cause the copper coating nearest the strip to press the strip outwards; in other words, the known techniques provide no release angle for the copper plates deposited on the electrode plates.

The plastic strips normally seat solely along the vertical side edges of the cathode plate, and the bottom edge which is most likely to be damaged when the plate is stripped is insulating with a layer of wax in known techniques. The use of wax as a one-time insulation means that each time the cathode element is striped, it is necessary to clean the cathode element in a washing plant before a new layer of wax can be applied to the cathode. It is essential that no electrically insulating wax residues remain on the main surfaces of the cathode element where copper is to be precipitated, since the presence of any such insulating residues would result in holes in the copper plate formed on the cathode.

SUMMARY OF THE INVENTION

The object of the present invention is therefore to provide a reusable-type of cathode element that overcomes the aforesaid difficulties and which after being stripped can be again submerged in the electrolyte bath without needing to treat the cathode element to any significant extent.

This object is achieved with a cathode element according to the following Claims.

BRIEF DESCRIPTION OF THE DRAWINGS

The invention will now be described in more detail with reference to the accompanying drawings, in which.

DETAILED DESERTION OF THE PREFERRED EMBODIMENTS

Figure 1:
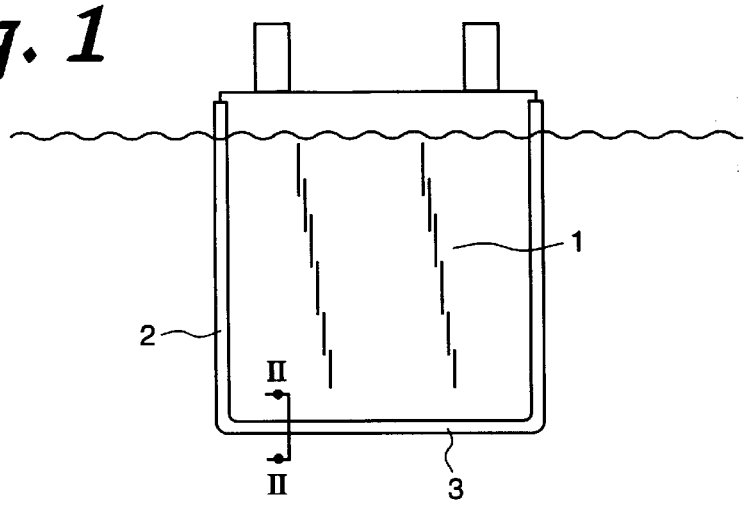
FIG. 1 illustrates schematically an inventive cathode element submerged in an electrolyte bath.

FIG. 1 illustrates schematically a cathode element submerged in an electrolyte bath for producing electrolytic copper in a known manner. As described above, the cathode element comprises a cathode plate 1 and electrically insulating edge strips 2, 3 which extend at least around those side edges of the cathode plate 1 which in an active position are located in the bath, so as to avoid a sleeve-like build-up of copper around the entire cathode plate 1.

According to the present invention, the electrically insulating edge strips 2, 3 are fixed to the cathode plate 1 by chemical reaction (gluing, vulcanizing) and in a preferred embodiment are fixedly vulcanized to the cathode plate 1. According to a particularly preferred embodiment, the electrically insulating edge strips that cover three of the four sides of the rectangular cathode plate have the form of a single-piece structure which prevents the formation of copper at joints between mutually adjacent strips.

With the intention of avoiding the formation of undercuts, gaps or like spaces where deposits can form or where copper build-up can affect the strip, the edge strip is configured so as to form a release angle for the copper layer built-up on the main surface of the cathode plate. In this regard, the strip profile will preferably exhibit an angle of incidence to the main surface of the cathode plate smaller than 90°.

Figure 2:
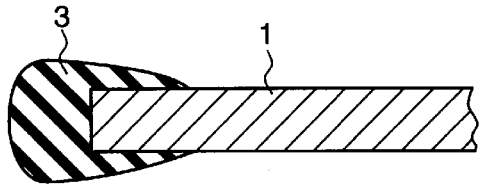
FIG. 2 is a schematic cross-sectional view of the cathode element shown in FIG. 1.

According to one preferred embodiment, illustrated schematically in FIG. 2, at least the cross-sectional profile of the bottom edge strip 3 has a generally droplet-like shape. The transition of the edge strip material to the cathode plate can be said to decrease generally asymptotically. This cross-sectional shape minimizes the risk of cathode slime collecting on the edge strip 3, e.g. in pockets and undercuts where the cathode slime contaminates the copper layer. Other profiled shapes which fulfill the release-angle and run-off requirement can be used, however.

The illustrated cathode plate is made of an acid-proof, stainless steel and the edge strip is made of an electrolyte durable rubber material, e.g. EPDM (ethylene propylene rubber), FPM (fluorine rubber), SBR (styrene rubber).

In the manufacture of cathode elements, the cathode plate is placed in a closable moulding tool, which seats a region, a mould passageway, which in shape and extension corresponds to the desired edge strip. Rubber or elastomeric material is then pressed or injected through a gate and into the mould passageway, whereafter the mould is held closed until vulcanization is complete. Prior to this vulcanization process, the cathode plate is treated in some suitable way to facilitate satisfactory adhesion with the rubber, e.g. is blasted and/or ground and washed and then coated with primer and an adhesive agent.

Thus, in order to achieve an optimal function, a chemical bond is formed in each point of contact between the edge strip and the cathode plate.

Figure 3:
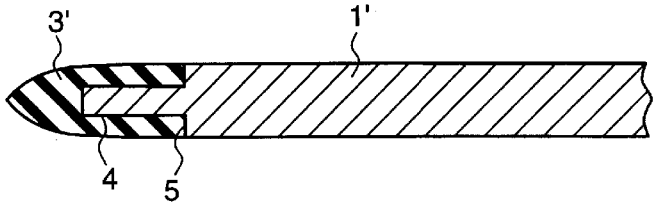
FIG. 3 and FIG. 4 are schematic cross-sectional views of alternative embodiments of the cathode element shown in FIG. 2.

According to one additional embodiment, illustrated schematically in FIG. 3, the strip 3' is arranged at least partially countersunk in the cathode plate 1'. Thereby eliminating the risk for cathode slime collection e.g. on the lower edge strip 3', (no pockets and no undercuts). The countersink also minimizes the risk of the copperplate damaging the strip 3' mechanically during stripping, since the edge strip 3' exhibits a cross-sectional thickness at the outer surface transition equal to or preferably below the thickness of the cathode plate 1.

Figure 4:
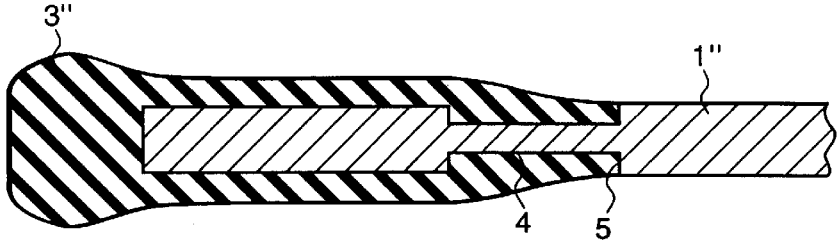

The countersinks 4 in the cathode plate 1' main sides are preferably following the side edges with or without interjacent plate material (see FIG. 4 and FIG. 3 respectively).

The countersink 4 could be a machined or in other way produced groove, preferably more broad then it is deep 5.

It will be understood that although the invention has been described above with reference to a preferred embodiment thereof which utilizes a vulcanization process, other embodiments are conceivable where the edge strip is attached to the cathode plate by similar chemical bonds, without departing from the scope of the present invention. For instance, the chemical bonds between cathode plate and edge strip can be achieved with the aid of glue. It is also possible to extrude the edge strip to a desired configuration and thereafter firmly glue the strip to the edge of the cathode plate.

I claim:

1. A method of producing a cathode element, comprising:

placing a cathode plate (1) in a closable moulding tool that exhibits moulding passageways of desired cross-sectional probe along side edges of the cathode plate where strips shall be formed;

introducing rubber or elastomeric material into the moulding passageways; and holding the moulding tool closed until vulcanization is complete.

2. A method according to claim 1, further comprising blasting and/or grinding, polishing and washing the cathode plate, and coating the side edges with primer and adhesive agent prior to placing the cathode plate in the moulding tool.

3. A cathode element for the production of electrolytic copper, wherein the cathode element is a reusable element and includes a cathode plate (1) and electrically insulating edge strips (2,3) around at least those cathode element side edges which, in an active position, are located in the electrolyte bath, therewith to prevent a sleeve formation of copper around said cathode element, wherein countersinks are provided along opposite sides of at least one of the cathode plate side edges for receiving an edge strip and the electrically insulating edge strips (2,3) comprise an electrolyte resistant rubber material firmly vulcanized to the cathode plate (1).

4. A cathode element according to claim 3, wherein electrically insulating edge strips (2,3) have the form of a one-piece structure.

5. A cathode element according to claim 3, wherein an outer surface of respective edge strips inclines towards the cathode plate surface at a junction of said surface to said cathode plate at an angle of incidence smaller than 90°.

6. A cathode element according to claim 3, wherein a bottom of the edge strip (3) has a generally droplet shape.

7. A cathode element according to claim 3, wherein the countersinks are broader than they are deep.

8. A cathode element according to claim 3, wherein the edge strips (2,3) comprise a rubber material selected from the group consisting of ethylene propylene rubber, fluorine rubber, and styrene rubber.

* * * * *